US008712301B2

(12) United States Patent
Iwai

(10) Patent No.: US 8,712,301 B2
(45) Date of Patent: Apr. 29, 2014

(54) FIXING DEVICE AND IMAGE FORMING APPARATUS

(75) Inventor: Kiyoshi Iwai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 13/292,488

(22) Filed: Nov. 9, 2011

(65) Prior Publication Data

US 2012/0328340 A1 Dec. 27, 2012

(30) Foreign Application Priority Data

Jun. 22, 2011 (JP) ..... 2011-138194

(51) Int. Cl.
*G03G 15/20* (2006.01)

(52) U.S. Cl.
USPC ..... 399/329; 399/330

(58) Field of Classification Search
USPC ..... 399/328, 329, 330, 333; 219/216, 619, 219/672, 676, 677
See application file for complete search history.

(56) References Cited

U.S. PATENT DOCUMENTS

| | | | | |
|---|---|---|---|---|
| 2009/0067903 | A1* | 3/2009 | Yokoyama et al. | 399/330 |
| 2010/0247184 | A1* | 9/2010 | Iwai | 399/329 |
| 2012/0093546 | A1* | 4/2012 | Ohara et al. | 399/329 |

FOREIGN PATENT DOCUMENTS

| | | | |
|---|---|---|---|
| JP | 2001-312164 | A | 11/2001 |
| JP | 2002-040846 | A | 2/2002 |
| JP | 2002-072738 | A | 3/2002 |
| JP | 2006-285126 | A | 10/2006 |
| JP | 2009-014896 | A | 1/2009 |

* cited by examiner

*Primary Examiner* — Sophia S Chen
(74) *Attorney, Agent, or Firm* — Sughrue Mion, PLLC

(57) ABSTRACT

A fixing device includes a fixing member that includes a conductive layer and fixes toner on a recording material with heat generated in the conductive layer by electromagnetic induction; a magnetic-field-producing member that produces an alternating-current magnetic field when an alternating current is supplied to the magnetic-field-producing member, the alternating-current magnetic field intersecting the conductive layer; a first support member that faces the magnetic-field-producing member and has a first projection which projects toward the magnetic-field-producing member, the first support member supporting the magnetic-field-producing member at the first projection; and a second support member that faces the first support member with the magnetic-field-producing member interposed therebetween, the second support member supporting the magnetic-field-producing member by pressing the magnetic-field-producing member against the first support member.

12 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2011-138194 filed Jun. 22, 2011.

BACKGROUND

(i) Technical Field

The present invention relates to a fixing device and an image forming apparatus.

SUMMARY

According to an aspect of the invention, there is provided a fixing device including a fixing member that includes a conductive layer and fixes toner on a recording material with heat generated in the conductive layer by electromagnetic induction; a magnetic-field-producing member that produces an alternating-current magnetic field when an alternating current is supplied to the magnetic-field-producing member, the alternating-current magnetic field intersecting the conductive layer; a first support member that faces the magnetic-field-producing member and has a first projection which projects toward the magnetic-field-producing member, the first support member supporting the magnetic-field-producing member at the first projection; and a second support member that faces the first support member with the magnetic-field-producing member interposed therebetween, the second support member supporting the magnetic-field-producing member by pressing the magnetic-field-producing member against the first support member.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the accompanying drawings.

First Exemplary Embodiment

Image Forming Apparatus

Figure 1:
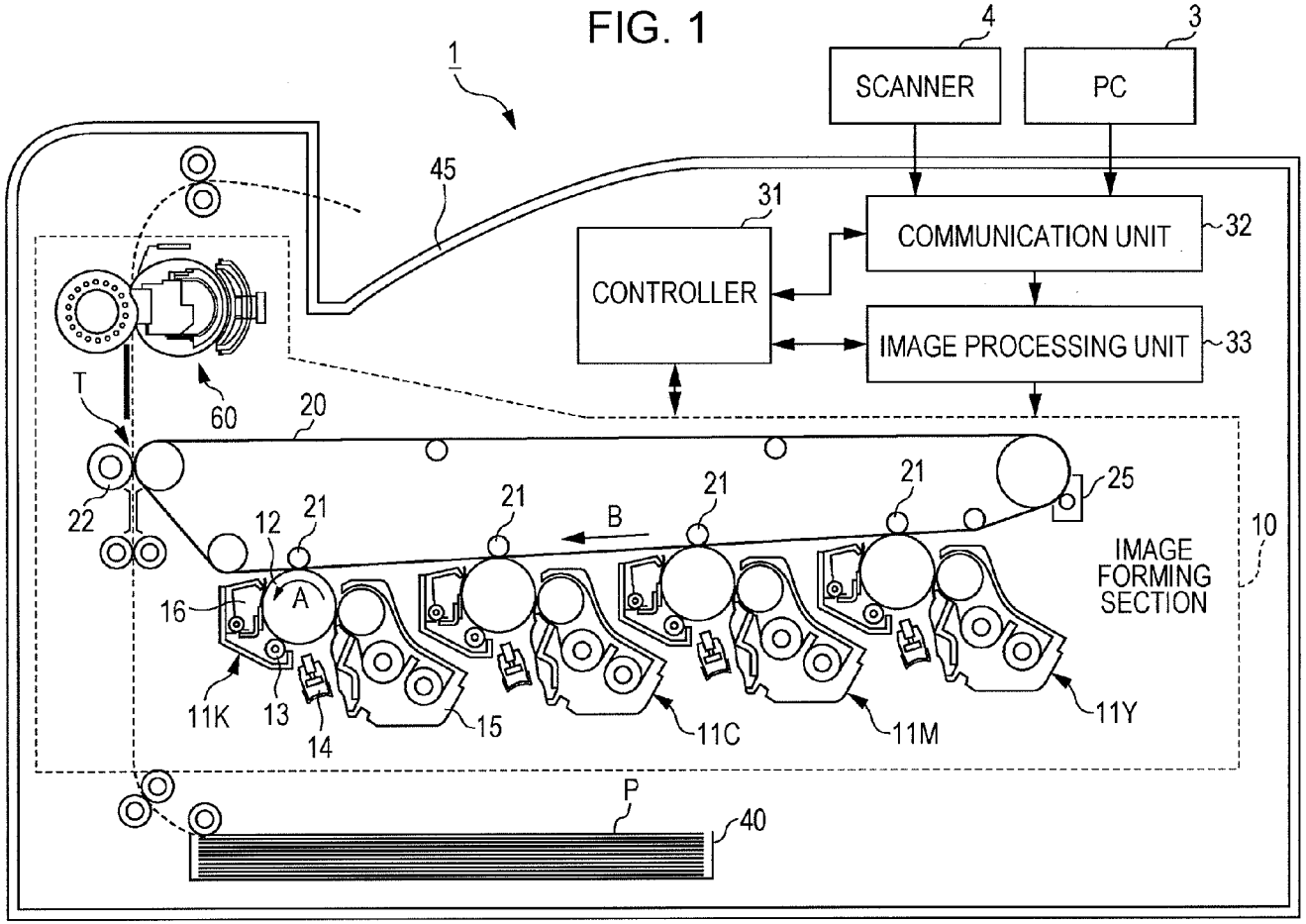
FIG. 1 illustrates an exemplary image forming apparatus to which a fixing device according to a first exemplary embodiment is applied.

FIG. 1 illustrates an exemplary image forming apparatus 1 to which a fixing device according to a first exemplary embodiment is applied. The image forming apparatus 1 illustrated in FIG. 1 is a tandem color printer and includes an image forming section 10 that forms an image on the basis of image data, a controller 31 that controls the overall operation of the image forming apparatus 1, a communication unit 32 that communicates with, for example, a personal computer (PC) 3 or an image reading device (scanner) 4 and receives the image data, and an image processing unit 33 that performs a predetermined image processing operation on the image data received by the communication unit 32.

The image forming section 10 includes four image forming units 11Y, 11M, 11C, and 11K (also generally referred to as "image forming units 11") that are provided side by side at predetermined intervals. The image forming units 11 are exemplary toner-image-forming sections and each include a photoconductor drum 12 on which an electrostatic latent image is formed and that carries a toner image, a charging device 13 that uniformly charges the surface of the photoconductor drum 12 with a predetermined potential, a light-emitting-diode (LED) printhead 14 that performs, on the basis of image data for a corresponding one of different colors, exposure on the photoconductor drum 12 charged by the charging device 13, a developing device 15 that develops the electrostatic latent image formed on the photoconductor drum 12, and a drum cleaner 16 that cleans the surface of the photoconductor drum 12 after transfer.

The image forming units 11 all have substantially the same configuration except the colors of toners contained in the developing devices 15. The image forming units 11 form toner images in different colors of yellow (Y), magenta (M), cyan (C), and black (K), respectively.

The image forming section 10 also includes an intermediate transfer belt 20 to which the toner images in different colors formed on the photoconductor drums 12 of the respective image forming units 11 are multiply transferred, first transfer rollers 21 with which the toner images in different colors formed by the respective image forming units 11 are sequentially transferred (first-transferred) to the intermediate transfer belt 20 in such a manner as to be superposed one on top of another, a second transfer roller 22 with which the toner images in different colors superposed on the intermediate transfer belt 20 are transferred at a time (second-transferred) to paper P, i.e., a recording material (recording paper), and a fixing unit 60 as an exemplary fixing section (fixing device) that fixes the second-transferred toner images in different colors on the paper P. In the image forming apparatus 1 according to the first exemplary embodiment, the intermediate transfer belt 20, the first transfer rollers 21, and the second transfer roller 22 in combination form a transfer section.

The image forming apparatus 1 according to the first exemplary embodiment performs an image forming operation in the following process under the control of the controller 31. Specifically, image data from the PC 3 or the scanner 4 is received by the communication unit 32 and is subjected to the predetermined image processing operation performed by the image processing unit 33, thereby being converted into pieces of image data for the different colors. The pieces of image data are transmitted to the respective image forming units 11. For example, in the image forming unit 11K that forms a black (K)-colored toner image, the photoconductor drum 12 rotating in the direction of arrow A is uniformly charged with the predetermined potential by the charging device 13, and the LED printhead 14 performs scan exposure on the photoconductor drum 12 on the basis of the piece of image data for the K color transmitted from the image processing unit 33. Thus, an electrostatic latent image for the K color is formed on the photoconductor drum 12. The electrostatic latent image for the K color on the photoconductor drum 12 is developed by the developing device 15, whereby a K-colored toner image is formed on the photoconductor drum 12. Likewise, yellow (Y)-colored, magenta (M)-colored, and cyan (C)-colored toner images are formed by the other image forming units 11Y, 11M, and 11C, respectively.

The different-colored toner images thus formed on the photoconductor drums 12 of the respective image forming units 11 are sequentially electrostatically transferred (first-transferred) to the intermediate transfer belt 20 rotating in the direction of arrow B by the respective first transfer rollers 21, whereby a toner image superposition in which the different-colored toners are superposed is formed. The toner image superposition on the intermediate transfer belt 20 is transported, with the rotation of the intermediate transfer belt 20, to an area (second transfer part T) where the second transfer roller 22 is provided. When the toner image superposition reaches the second transfer part T, paper P fed from a paper holder 40 is transported to the second transfer part T. Subsequently, at the second transfer part T, the toner image superposition is electrostatically transferred at a time (second-transferred) to the thus transported paper P by an effect of a transfer electric field produced by the second transfer roller 22.

Subsequently, the paper P having the toner image superposition electrostatically transferred thereto is transported to the fixing unit 60. The toner image superposition on the paper P transported to the fixing unit 60 is subjected to heat and pressure applied by the fixing unit 60 and is thus fixed on the paper P. The paper P having the thus fixed image is transported to a paper stacking part 45 in a paper output portion of the image forming apparatus 1.

Meanwhile, toners adhering to the photoconductor drums 12 after the first transfer (first-transfer residual toner) and toners adhering to the intermediate transfer belt 20 after the second transfer (second-transfer residual toner) are removed by the drum cleaners 16 and a belt cleaner 25, respectively.

The image forming apparatus 1 repeats the above image forming process for the number of pages to be printed.

Fixing Unit

The fixing unit 60 according to the first exemplary embodiment will now be described.

Figure 2:
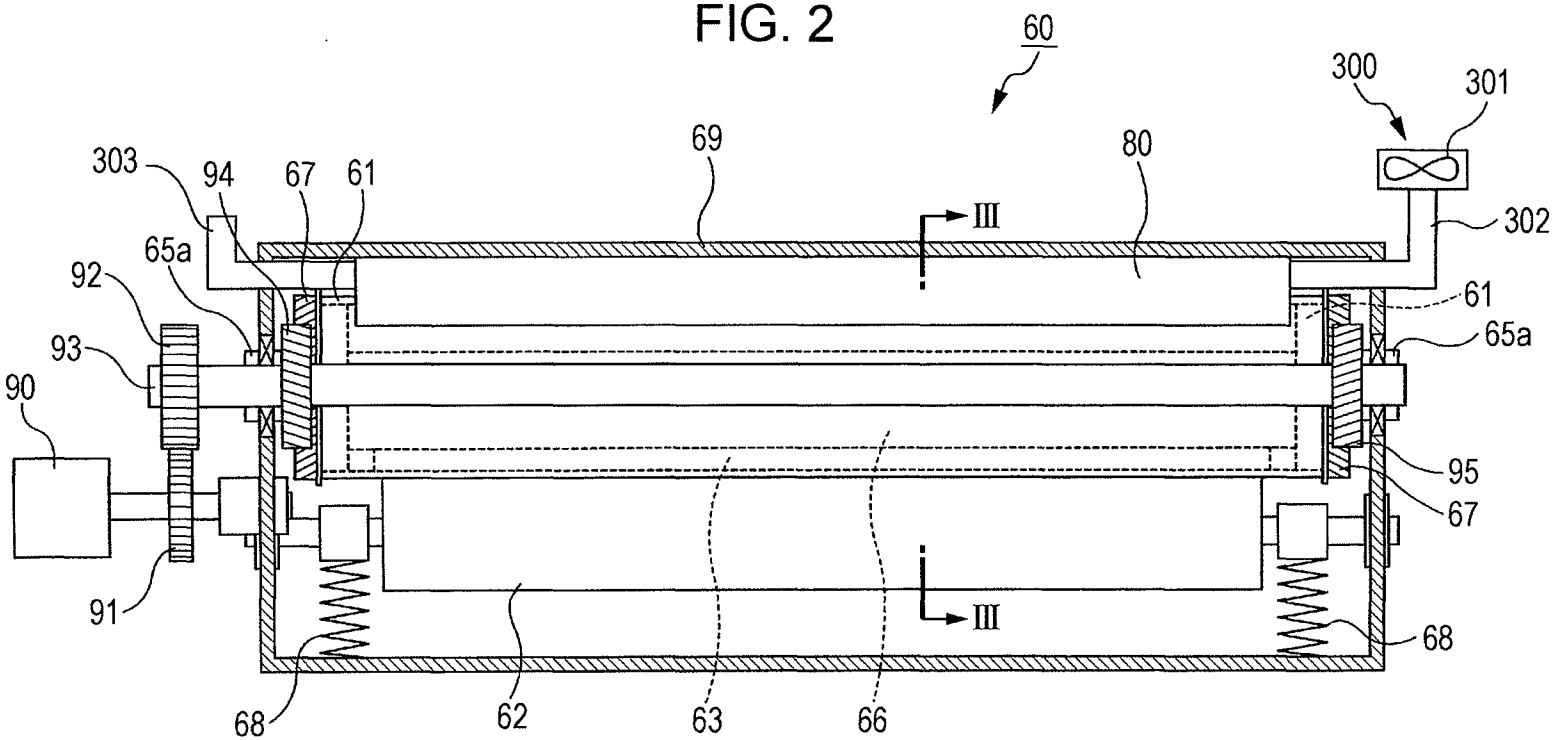
FIG. 2 is a front view of the fixing device according to the first exemplary embodiment.
Figure 3:
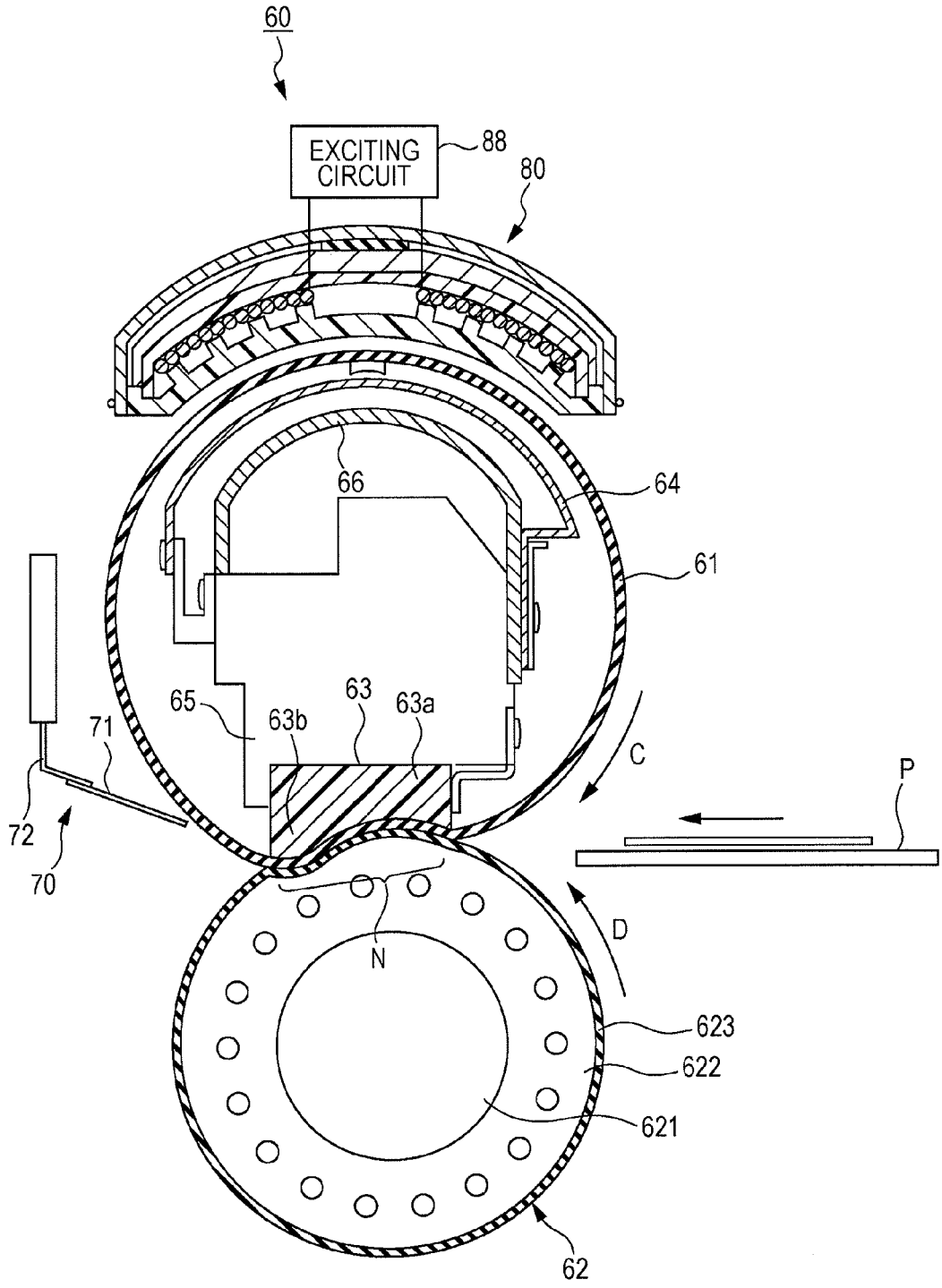
FIG. 3 is a sectional view of the fixing device according to the first exemplary embodiment.

FIGS. 2 and 3 illustrate the fixing unit 60 according to the first exemplary embodiment. FIG. 2 is a front view. FIG. 3 is a sectional view taken along line III-III illustrated in FIG. 2.

Referring to the sectional view in FIG. 3, the fixing unit 60 includes an induction-heating (IH) heater 80 that produces an alternating-current magnetic field, a fixing belt 61 as an exemplary fixing member that is heated by electromagnetic induction caused by the IH heater 80 and thus fixes the toner image superposition, a pressure applying roller 62 that faces the fixing belt 61, and a pressure receiving pad 63 against which the pressure applying roller 62 is pressed with the fixing belt 61 interposed therebetween.

Furthermore, the fixing unit 60 includes a holder 65 that supports the pressure receiving pad 63 and other elements, a temperature-sensitive magnetic member 64 that produces a magnetic path by inducing thereinto the alternating-current magnetic field produced by the IH heater 80, an induction member 66 that induces thereinto lines of magnetic force that have passed through the temperature-sensitive magnetic member 64, and a release assisting member 70 that assists releasing of the paper P from the fixing belt 61.

Furthermore, as illustrated in the front view in FIG. 2, the fixing unit 60 includes a blower unit 300 as an exemplary blower (blower member) that feeds cooling air to the IH heater 80.

Fixing Belt

Figure 4:
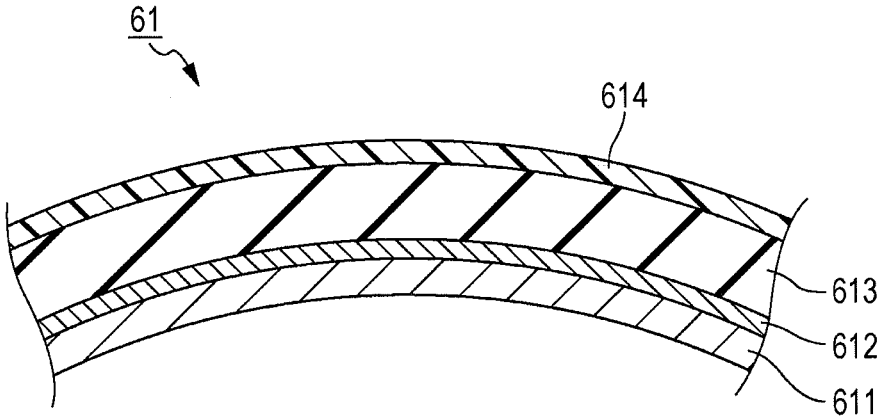
FIG. 4 illustrates layers included in a fixing belt.

FIG. 4 illustrates layers included in the fixing belt 61. The fixing belt 61 is an endless belt member that originally has a round cylindrical shape with, for example, a diameter of 30 mm in its original shape (round cylindrical shape) and a length of 370 mm. As illustrated in FIG. 4, the fixing belt 61 is a multilayer belt member including a base layer 611, a conductive heating layer 612 overlying the base layer 611, an elastic layer 613 improving the capability of fixing the toner image superposition, and a surficial release layer 614 forming the outermost layer.

The base layer 611 supports the conductive heating layer 612, having a small thickness, and is a heat-resistant sheet member that provides good mechanical strength to the fixing belt 61 as a whole. The base layer 611 is made of a material having a thickness and physical properties (relative permeability and resistivity) that allow the alternating-current magnetic field produced by the IH heater 80 to pass therethrough and to act on the temperature-sensitive magnetic member 64. The base layer 611 itself, however, does not generate heat or hardly generates heat with the effect of the magnetic field.

Specifically, for example, the base layer 611 is made of non-magnetic metal, such as non-magnetic stainless steel, having a thickness of 30 μm to 200 μm (preferably, 50 μm to 150 μm), a resin material having a thickness of 60 μm to 200 μm, or the like.

The conductive heating layer 612 is an exemplary conductive layer and is an electromagnetic-induction heating layer that is heated by electromagnetic induction caused by the alternating-current magnetic field produced by the IH heater 80. That is, an eddy current occurs in the conductive heating layer 612 when the alternating-current magnetic field produced by the IH heater 80 passes through the conductive heating layer 612 in the thickness direction.

Usually, a general-purpose power supply manufacturable at a low cost is used as the power source for an exciting circuit 88 (see FIG. 6) that supplies an alternating current to the IH heater 80. Therefore, the frequency of the alternating-current magnetic field produced by the IH heater 80 usually ranges from 20 kHz to 100 kHz, corresponding to the frequency of the general-purpose power supply. Hence, the conductive heating layer 612 is configured to allow an alternating-current magnetic field at a frequency of 20 kHz to 100 kHz to enter and pass therethrough.

The alternating-current magnetic field is allowed to enter a region of the conductive heating layer 612 where the alternating-current magnetic field is attenuated to 1/e. The region is defined by "skin depth (δ)", which is obtained from Expression (1) below.

$$\delta = 503\sqrt{\frac{\rho}{f \cdot \mu_r}} \quad (1)$$

where f denotes the frequency of the alternating-current magnetic field (20 kHz, for example), ρ denotes the resistivity (Ω·m), and μ denotes the relative permeability.

Hence, the conductive heating layer 612 is thinner than the skin depth (δ) of the conductive heating layer 612 defined by Expression (1) so that an alternating-current magnetic field at a frequency of 20 kHz to 100 kHz is allowed to enter and pass through the conductive heating layer 612. Exemplary materials for the conductive heating layer 612 include metals such as Au, Ag, Al, Cu, Zn, Sn, Pb, Bi, Be, and Sb, and alloys of any of the foregoing metals.

Specifically, for example, the conductive heating layer 612 is made of non-magnetic metal such as Cu (paramagnetic material having a relative permeability of about 1) with a thickness of 2 μm to 20 μm and a resistivity of $2.7\times10^{-8}$ Ω·m or smaller.

The conductive heating layer 612 may have such a small thickness in terms of reducing the time required for heating the fixing belt 61 to a preset fixing temperature (hereinafter referred to as "warm-up time").

The elastic layer 613 is made of a heat-resistant elastic material such as silicone rubber. The toner image superposition on the paper P, i.e., the object of fixing, includes layers of powder toners having different colors. Therefore, to heat the entirety of the toner image superposition very uniformly at a nip part N, the surface of the fixing belt 61 may be deformable along a rugged surface formed by the toner image superposition on the paper P. In such a case, silicone rubber having, for example, a thickness of 100 μm to 600 μm and a hardness of 10° to 30° (JIS-A) is suitable for the elastic layer 613.

The surficial release layer 614 directly comes into contact with an unfixed toner image superposition on the paper P and is therefore made of a material having a high releasability. Examples of such a material include a tetrafluoroethylene-perfluoroalkyl vinyl ether copolymer (PFA), polytetrafluoroethylene (PTFE), a silicone copolymer, and a composite of the foregoing materials. If the surficial release layer 614 is too thin, abrasion resistance is insufficient and the life of the fixing belt 61 is shortened. In contrast, if the surficial release layer 614 is too thick, the heat capacity of the fixing belt 61 is too large and the warm-up time is increased. Considering the balance between abrasion resistance and heat capacity, the thickness of the surficial release layer 614 may be 1 μm to 50 μm.

Pressure Receiving Pad

The pressure receiving pad 63 is made of an elastic material such as silicone rubber or fluoro rubber, or a heat-resistant resin such as liquid crystalline polymer (LCP) or polyphenylene sulfide (PPS). The pressure receiving pad 63 is supported by the holder 65 at a position facing the pressure applying roller 62 (see FIG. 3). In a state where the pressure receiving pad 63 is pressed by the pressure applying roller 62 with the fixing belt 61 interposed therebetween, the nip part N is formed between the pressure receiving pad 63 and the pressure applying roller 62.

The pressure receiving pad 63 includes a pre-nip region 63*a* on an entrance side (the upstream side in the direction of transport of the paper P) of the nip part N and a releasing nip region 63*b* on an exit side (the downstream side in the direction of transport of the paper P) of the nip part N. The pre-nip region 63*a* and the releasing nip region 63*b* receive different nip pressures. Specifically, a surface of the pre-nip region 63*a* nearer to the pressure applying roller 62 extends in an arc shape substantially along the outer peripheral surface of the pressure applying roller 62 and receives a uniform nip pressure over a wide area of the nip part N. The releasing nip region 63*b* has such a shape that a portion of the fixing belt 61 running therealong has a small radius of curvature. Furthermore, the releasing nip region 63*b* receives a large nip pressure locally applied thereto from the surface of the pressure applying roller 62. Thus, a curl in a direction away from the surface of the fixing belt 61 (a down curl) is formed in the paper P running along the releasing nip region 63*b*, whereby releasing of the paper P from the surface of the fixing belt 61 is facilitated.

In the first exemplary embodiment, the release assisting member 70 as an assist member that assists releasing of the paper P by the pressure receiving pad 63 is provided on the downstream side with respect to the nip part N. The release assisting member 70 includes a release baffle 71 and a holder 72 that supports the release baffle 71. The release baffle 71 is oriented in a direction (counter direction) opposite to the direction of rotation of the fixing belt 61 and extends to a position close to the fixing belt 61. The release baffle 71 supports the curl formed in the paper P at the exit of the pressure receiving pad 63, thereby preventing the paper P from advancing along the fixing belt 61.

Temperature-Sensitive Magnetic Member

The temperature-sensitive magnetic member 64 has an arc shape extending along the inner peripheral surface of the fixing belt 61. The temperature-sensitive magnetic member 64 is positioned close to, but is not in contact with, the inner peripheral surface of the fixing belt 61 with a predetermined gap (0.5 mm to 1.5 mm, for example) interposed therebetween. The temperature-sensitive magnetic member 64 is positioned closed to the fixing belt 61 so that the temperature of the temperature-sensitive magnetic member 64 changes with the temperature of the fixing belt 61, that is, the temperature of the temperature-sensitive magnetic member 64 becomes substantially the same as the temperature of the fixing belt 61. The temperature-sensitive magnetic member 64 is not in contact with the fixing belt 61 so that the heat of the fixing belt 61 is prevented from being absorbed into the temperature-sensitive magnetic member 64 before the fixing belt 61 is heated to the preset fixing temperature after the power of the image forming apparatus 1 is turned on. Thus, the warm-up time is reduced.

The temperature-sensitive magnetic member 64 is made of such a material that the temperature at which the magnetic permeability, one of magnetic properties, of the material suddenly changes (described separately below) is at or above the preset fixing temperature, at which toner images in different colors melt, and below the heat resistant temperatures of the elastic layer 613 and the surficial release layer 614 of the fixing belt 61. In other words, the temperature-sensitive magnetic member 64 is made of a material exhibiting "temperature-sensitive magnetism", that is, the temperature-sensitive magnetic member 64 changes reversibly between exhibiting ferromagnetism and non-magnetism (paramagnetism) in a temperature range including the preset fixing temperature. At or below the temperature at which magnetic permeability starts to change, the temperature-sensitive magnetic member 64 is ferromagnetic and functions as a magnetic-path-producing member that induces thereinto lines of magnetic force produced by the IH heater 80 and intersecting the fixing belt 61, thereby producing a magnetic path part of which runs through the temperature-sensitive magnetic member 64. Thus, the temperature-sensitive magnetic member 64 produces a closed magnetic path enclosing the fixing belt 61 and an exciting coil 82 (see FIG. 6) of the IH heater 80. In contrast, above the temperature at which magnetic permeability starts to change, the temperature-sensitive magnetic member 64 allows the lines of magnetic force produced by the IH heater 80 and intersecting the fixing belt 61 to pass therethrough in the thickness direction. Thus, the lines of magnetic force produced by the IH heater 80 and intersecting the fixing belt 61 form a magnetic path intersecting the temperature-sensitive magnetic member 64, running through the induction member 66, and returning to the IH heater 80.

The "temperature at which magnetic permeability starts to change" refers to a temperature at which magnetic permeability (measured in accordance with JIS C2531, for example) starts to drop continuously, specifically, a temperature at which the amount of magnetic flux (the number of lines of magnetic force) permeating through the temperature-sensitive magnetic member 64 and other elements starts to change. That is, the temperature at which magnetic permeability starts to change is close to the Curie point, at which materials lose their magnetism, but is based on a concept different from the Curie point.

The temperature-sensitive magnetic member 64 is made of such a material that the temperature at which magnetic permeability starts to change is within the range of, for example, 140° C. (the preset fixing temperature) to 240° C. Examples of such a material include binary magnetic shunt steels such as an Fe—Ni alloy (permalloy) and ternary magnetic shunt steel such as an Fe—Ni—Cr alloy. In the case of an Fe—Ni binary magnetic shunt steel, the temperature at which magnetic permeability starts to change may be set to about 225° C. in a proportion (atomic ratio) of about 64% for Fe to about 36% for Ni. Metal alloys such as permalloys and magnetic shunt steels are easy to mold and easy to machine, have high heat conductivity, and are inexpensive. Therefore, such metal alloys are suitable for the temperature-sensitive magnetic member 64. Exemplary components of such metal alloys include Fe, Ni, Si, B, Nb, Cu, Zr, Co, Cr, V, Mn, and Mo.

The temperature-sensitive magnetic member 64 is made thinner than the skin depth δ (see Expression (1) above) that allows entry of the alternating-current magnetic field (lines of magnetic force) produced by the IH heater 80. For example, in the case of an Fe—Ni alloy, the thickness of the temperature-sensitive magnetic member 64 is set to about 50 μm to about 300 μm.

Holder

The holder 65 supporting the pressure receiving pad 63 is made of a highly rigid material so that the amount of bend thereof occurring when a pressing force is applied thereto by the pressure applying roller 62 becomes smaller than a predetermined amount. Thus, the pressure at the nip part N (nip pressure) is maintained to be uniform in the longitudinal direction. The fixing unit 60 according to the first exemplary embodiment employs a configuration in which the fixing belt 61 is heated by utilizing electromagnetic induction. Accordingly, the holder 65 is made of a material that does not affect or hardly affects the induction field and is not affected or is hardly affected by the induction field. Examples of such a material include heat-resistant resins such as glass-filled polyphenylene sulfide (PPS), and paramagnetic metals such as Al, Cu, and Ag.

Induction Member

The induction member 66 has an arc shape extending along the inner peripheral surface of the temperature-sensitive magnetic member 64. The induction member 66 is not in contact with the inner peripheral surface of the temperature-sensitive magnetic member 64 with a predetermined gap (1.0 mm to 5.0 mm, for example) interposed therebetween. The induction member 66 is made of non-magnetic metal, such as Ag, Cu, or Al, having relatively small resistivity. When the temperature-sensitive magnetic member 64 is heated to a temperature above the temperature at which magnetic permeability starts to change, the induction member 66 induces thereinto the alternating-current magnetic field (lines of magnetic force) produced by the IH heater 80, thereby falling into a state where an eddy current I occurs more easily than in the conductive heating layer 612 of the fixing belt 61. Hence, the induction member 66 has a thickness (1.0 mm, for example) much larger than the skin depth δ (see Expression (1) above) so as to allow the eddy current I to easily flow therethrough.

Drive Mechanism for Fixing Belt

A mechanism of driving the fixing belt 61 will now be described.

Referring to the front view in FIG. 2, the holder 65 (see FIG. 3) is provided with end cap members 67 secured at two axial ends thereof. The end cap members 67 rotate the fixing belt 61 in the circumferential direction while maintaining the circular sectional shape of the fixing belt 61 at two respective ends of the fixing belt 61. The fixing belt 61 directly receives a rotational driving force from the end cap members 67 at the two respective ends thereof and rotates in the direction of arrow C, illustrated in FIG. 3, at a process speed of, for example, 140 mm/s. In the first exemplary embodiment, a direction orthogonal to the direction of rotation of the fixing belt 61 (the width direction of the fixing belt 61) is referred to as the longitudinal direction of the fixing belt 61.

Figure 5A:
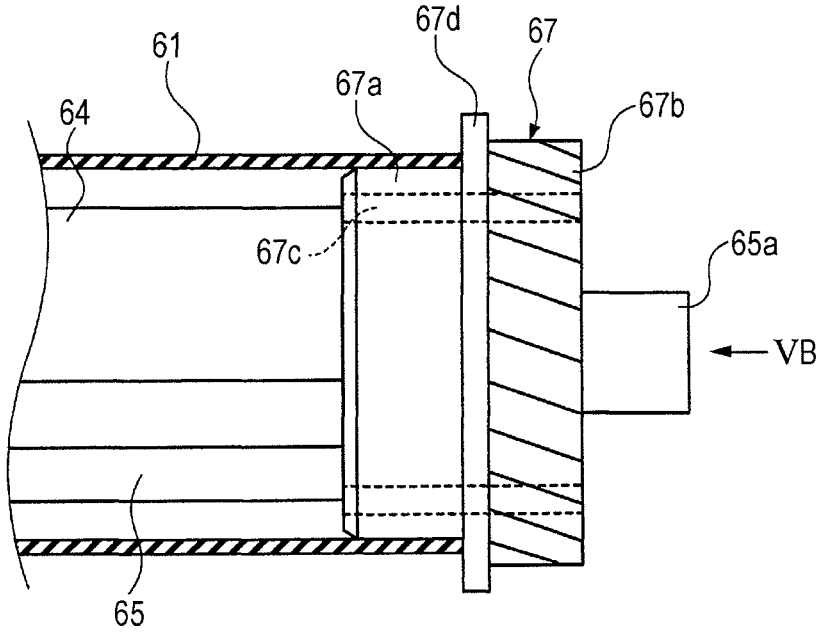
FIG. 5A is a side view of an end cap member.
Figure 5B:
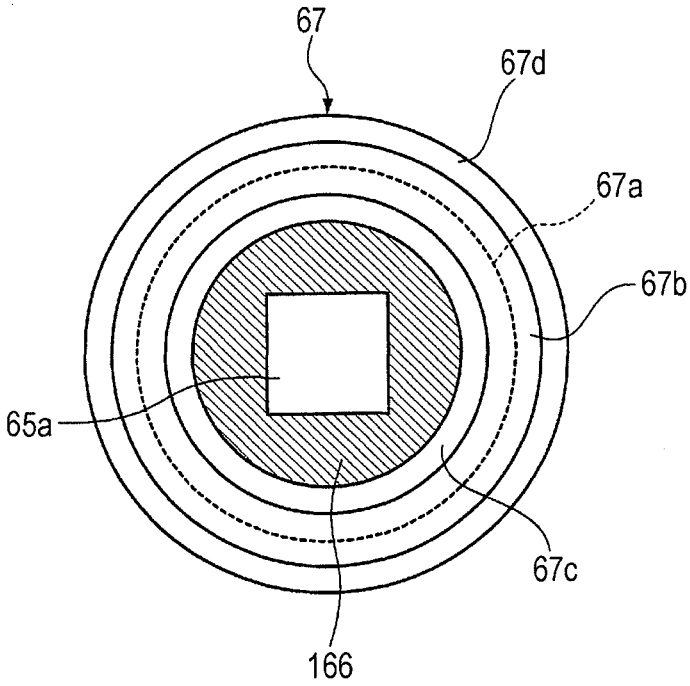
FIG. 5B is a plan view of the end cap member seen in the direction of arrow VB illustrated in FIG. 5A.

FIG. 5A is a side view of one of the end cap members 67. FIG. 5B is a plan view of the end cap member 67 seen in the direction of arrow VB illustrated in FIG. 5A. As illustrated in FIGS. 5A and 5B, the end cap members 67 each include a secured portion 67*a* fitted in the fixing belt 61 at a corresponding one of the two ends, a flange portion 67*d* having an outside diameter larger than that of the secured portion 67*a* and projecting in the radial direction with respect to the fixing belt 61 in a state where the end cap member 67 is fitted in the fixing belt 61, a gear portion 67*b* to which the rotational driving force is transmitted, and a bearing portion 67*c* rotatably connected to a supporting portion 65*a*, which is provided at each of two ends of the holder 65, with a connecting member 166 interposed therebetween. In a state where the supporting portions 65*a* provided at the two ends of the holder 65 are secured to two respective ends of a housing 69 of the fixing unit 60 as illustrated in FIG. 2, the end cap members 67 are supported in such a manner as to be rotatable with the aid of the respective bearing portions 67*c* connected to the supporting portions 65*a*.

The end cap members 67 are made of an engineering plastic having a high mechanical strength and a high heat resistance. Exemplary materials suitable for the end cap members 67 include phenolic resin, polyimide resin, polyamide resin, polyamide-imide resin, polyether ether keton (PEEK) resin, polyether sulfone (PES) resin, PPS resin, LCP resin, and the like.

As illustrated in FIG. 2, in the fixing unit 60, a rotational driving force from a drive motor 90 is transmitted to a shaft 93 through transmission gears 91 and 92 and is further transmitted to the end cap members 67 through transmission gears 94 and 95, respectively, provided on the shaft 93. Then, the rotational driving force is transmitted from the end cap members 67 to the fixing belt 61, causing the end cap members 67 and the fixing belt 61 to rotate together.

Thus, since the fixing belt 61 rotates by directly receiving the driving force at the two ends thereof, the fixing belt 61 rotates stably.

When the fixing belt 61 rotates by directly receiving the driving force from the end cap members 67 provided at the two ends thereof, a torque of about 0.1 N·m to 0.5 N·m usually acts on the fixing belt 61. The fixing belt 61 according to the first exemplary embodiment includes the base layer 611 made of, for example, non-magnetic stainless steel or the like having a high mechanical strength. Therefore, even if a torsional torque of about 0.1 N·m to 0.5 N·m acts over the entirety of the fixing belt 61, the fixing belt 61 is not liable to undergo buckling or the like.

The flange portions 67*d* of the end cap members 67 prevent the positional shift of the fixing belt 61. In this state, a compressive force of about 1 N to 5 N usually acts on the fixing belt 61 from each end (each flange portion 67*d*) in the axial direction. Even under such a compressive force, the fixing belt 61 is prevented from undergoing buckling or the like because the base layer 611 of the fixing belt 61 is made of non-magnetic stainless steel or the like.

As described above, since the fixing belt 61 according to the first exemplary embodiment rotates by directly receiving the driving force at the two ends thereof, the fixing belt 61 rotates stably. Moreover, since the base layer 611 of the fixing belt 61 is made of non-magnetic stainless steel or the like having a high mechanical strength, the fixing belt 61 is not liable to undergo buckling or the like even if a torsional torque or a compressive force acts thereon. Moreover, since the fixing belt 61 as a whole is flexible with the thinness of the base layer 611 and the conductive heating layer 612, the fixing belt 61 is deformable along the nip part N and is restorable to its original shape.

Referring now to FIG. 3, the pressure applying roller 62 faces the fixing belt 61 and rotates in the direction of arrow D illustrated in FIG. 3 at a process speed of, for example, 140 mm/s by following the rotation of the fixing belt 61. The nip part N is formed with the fixing belt 61 nipped between the pressure applying roller 62 and the pressure receiving pad 63. When paper P having an unfixed toner image superposition is transported through the nip part N, heat and pressure are applied to the toner image superposition, whereby the toner image superposition is fixed on the paper P.

The pressure applying roller 62 includes a solid aluminum core (round-columnar metal core) 621 having an exemplary diameter of 18 mm, a heat-resistant elastic layer 622 provided over the outer peripheral surface of the core 621 and made of silicone sponge or the like with an exemplary thickness of 5 mm, and a release layer 623 provided over the heat-resistant elastic layer 622 and as a heat-resistant resin coating composed of carbon-filled PFA or the like or a heat-resistant rubber coating with an exemplary thickness of 50 μm. The pressure applying roller 62 is pressed, by pressing springs 68 (see FIG. 2), against the pressure receiving pad 63 with the fixing belt 61 interposed therebetween and with an exemplary load of 25 kgf.

IH Heater

The IH heater 80 will now be described. The IH heater 80 produces an alternating-current magnetic field acting on the conductive heating layer 612 of the fixing belt 61 and thus heats the conductive heating layer 612 by electromagnetic induction.

Figure 6:
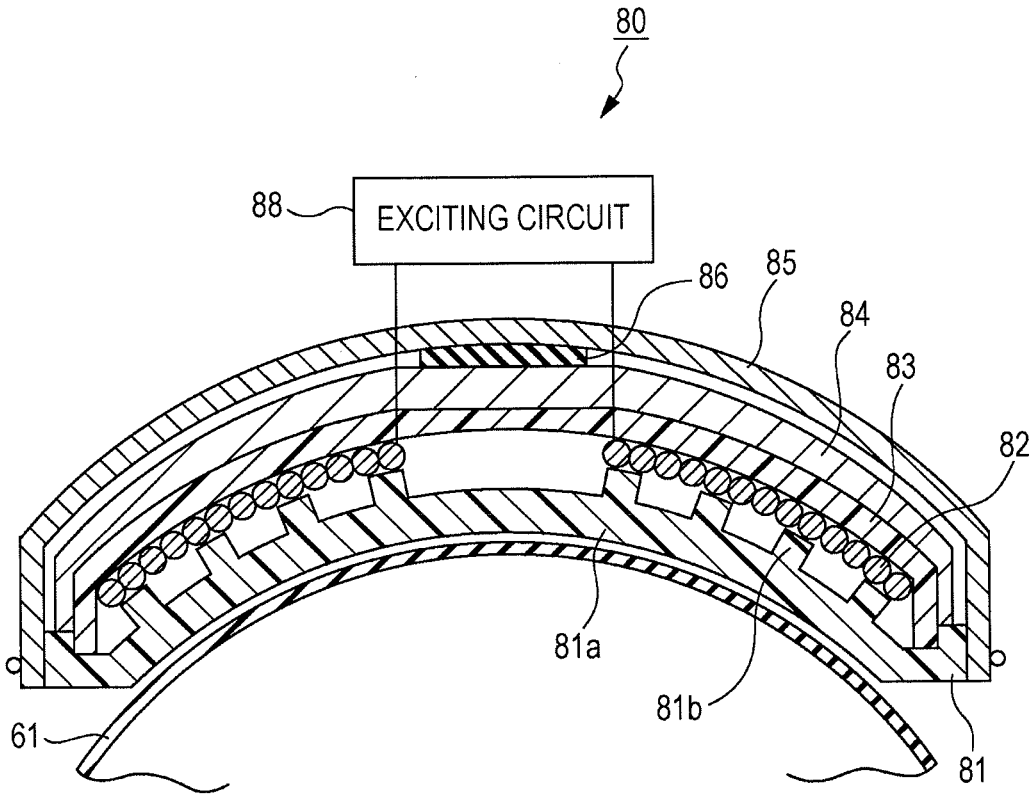
FIG. 6 is a sectional view of an induction-heating (IH) heater according to the first exemplary embodiment.
Figure 7:
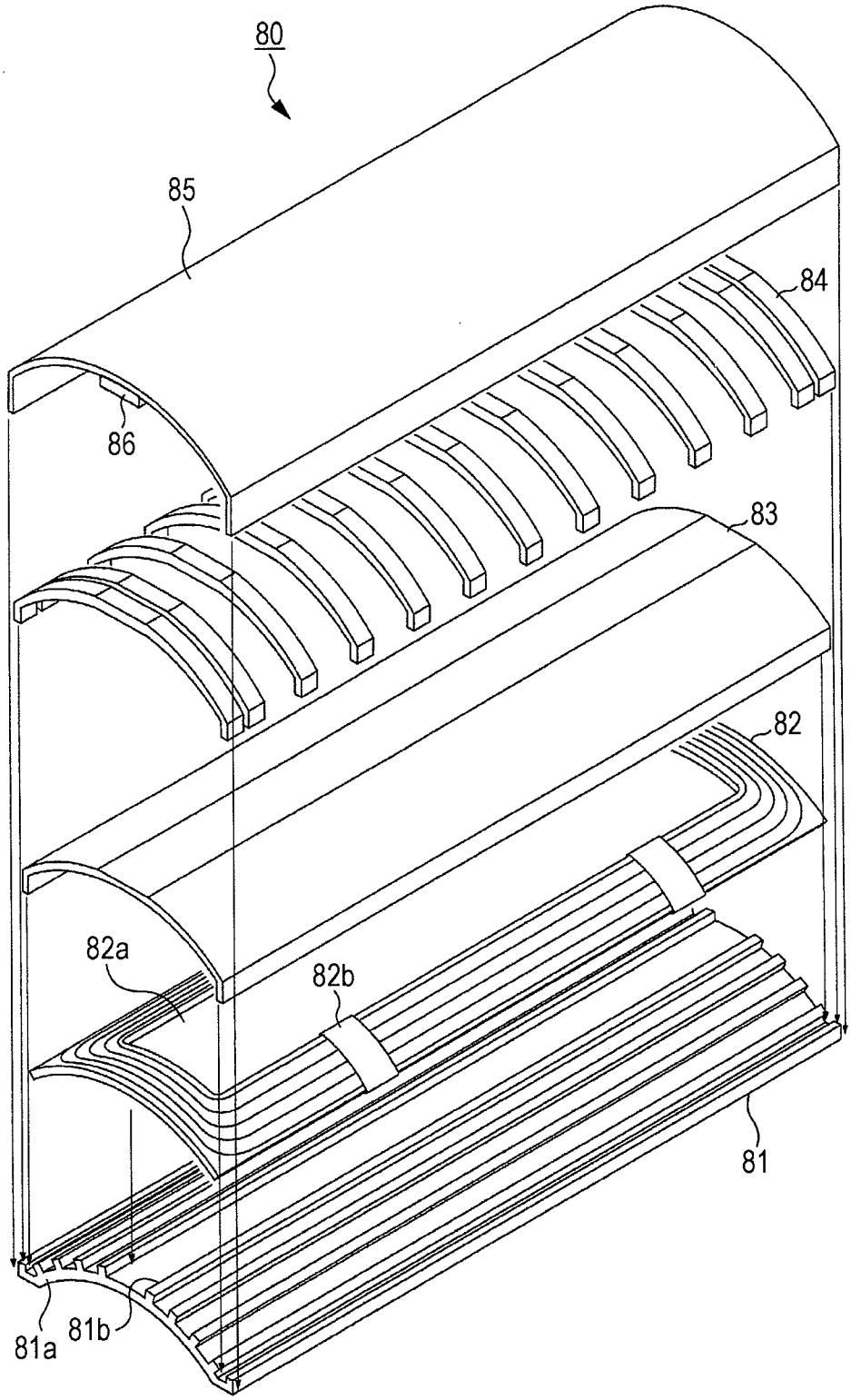
FIG. 7 is an exploded perspective view of the IH heater according to the first exemplary embodiment having a stack structure.

FIG. 6 is a sectional view of the IH heater 80 according to the first exemplary embodiment. FIG. 7 is an exploded perspective view of the IH heater 80 according to the first exemplary embodiment having a stack structure. As illustrated in FIG. 6, the IH heater 80 includes the exciting coil 82 as an exemplary magnetic-field-producing member producing an alternating-current magnetic field, an inner support 81 and an outer support 83 each made of a non-magnetic material such as heat-resistant resin and supporting the exciting coil 82, a magnetic core 84 as an exemplary magnetic core member producing a circuit of the alternating-current magnetic field produced by the exciting coil 82, a shield 85 shielding the magnetic field, a pressing member 86 pressing the magnetic core 84 toward the outer support 83, and the exciting circuit 88 supplying an alternating current to the exciting coil 82.

The exciting coil 82 is produced by coiling a Litz wire into a closed loop having any shape such as a circular oblong shape, an elliptic shape, or a rectangular shape with a hollow portion 82*a* provided therein. The Litz wire is a bundle of, for example, 90 copper wires insulated from one another and each having a diameter of, for example, 0.17 mm. The exciting coil 82 is oriented such that the longitudinal direction thereof coincides with the longitudinal direction of the fixing belt 61. In the first exemplary embodiment, the coil of Litz wire in the form of a hollow closed loop is fastened at plural positions with fastening tapes 82*b* so as not to be decoiled.

When an alternating current at a predetermined frequency is supplied from the exciting circuit 88 to the exciting coil 82, an alternating-current magnetic field centered on the Litz wire coiled in the form of the closed loop is produced around the exciting coil 82. The frequency of the alternating current supplied from the exciting circuit 88 to the exciting coil 82 usually ranges from 20 kHz to 100 kHz, corresponding to the frequency of the alternating current generated by the above-mentioned general-purpose power supply.

The inner support 81 according to the first exemplary embodiment is an exemplary first support member and includes a base 81*a* having a curved sectional shape extending along the surface of the fixing belt 61, and plural projections 81*b* projecting from the base 81*a* toward the exciting coil 82. As illustrated in FIG. 7, the plural projections 81*b* are exemplary protrusions and each extend, on the inner support 81, in a direction orthogonal to the direction of rotation of the fixing belt 61 and from one end of the inner support 81 to the other end (in the longitudinal direction of the fixing belt 61). The plural projections 81*b* are provided at specific intervals. Therefore, the surface of the base 81*a* of the inner support 81 is exposed from between adjacent projections 81*b*.

The inner support 81 is made of a heat-resistant non-magnetic material: for example, heat-resistant glass; heat-resistant resin such as polycarbonate, polyether sulfone, or PPS; or a material obtained by adding glass fibers to the heat-resistant resin.

The outer support 83 according to the first exemplary embodiment is an exemplary second support member and has a curved sectional shape extending along the surface of the exciting coil 82.

As with the inner support 81, the outer support 83 is made of a heat-resistant non-magnetic material: for example, heat-resistant glass; heat-resistant resin such as polycarbonate, polyether sulfone, or PPS; or a material obtained by adding glass fibers to the heat-resistant resin. The material of the outer support 83 may not necessarily be the same as that of the inner support 81. For example, the outer support 83 may be made of an insulating, heat-resistant, elastic material such as silicone rubber.

The magnetic core 84 is a ferromagnetic body composed of an acid compound or an alloy having high magnetic permeability such as soft ferrite, ferrite resin, an amorphous alloy, a permalloy, or magnetic shunt steel. The magnetic core 84 induces thereinto lines of magnetic force (magnetic flux) of the alternating-current magnetic field produced by the exciting coil 82 and produces a path of the lines of magnetic force (magnetic path) running from the magnetic core 84, intersecting the fixing belt 61 toward the temperature-sensitive magnetic member 64, running through the temperature-sensitive magnetic member 64, and returning to the magnetic core 84. That is, the alternating-current magnetic field produced by the exciting coil 82 runs through the magnetic core 84 and the temperature-sensitive magnetic member 64, producing a closed magnetic path with the lines of magnetic force thereof enclosing the fixing belt 61 and the exciting coil 82. Thus, the lines of magnetic force of the alternating-current magnetic field produced by the exciting coil 82 concentrate in a portion of the fixing belt 61 that faces the magnetic core 84.

The magnetic core 84 may be made of a material that causes a small loss in production of the magnetic path. Specifically, the magnetic core 84 may be used in a form that reduces the eddy current loss (for example, a configuration in which the current path is cut off or divided with slits or the like, or a configuration including thin plates tied to one another) and may be made of a material causing a small hysteresis loss.

The length of the magnetic core 84 in the direction of rotation of the fixing belt 61 is smaller than the length of the temperature-sensitive magnetic member 64 in the direction of rotation of the fixing belt 61. Thus, leakage of lines of magnetic force around the IH heater 80 is reduced, and the power factor is increased. Moreover, electromagnetic induction into metal members included in the fixing unit 60 is suppressed, and the efficiency in heating the fixing belt 61 (the conductive heating layer 612) is increased.

Stack Structure of IH Heater

The stack structure of the IH heater 80 according to the first exemplary embodiment will now be described.

Referring to FIG. 7, the IH heater 80 according to the first exemplary embodiment includes the inner support 81, the exciting coil 82, the outer support 83, the magnetic core 84, and the shield 85 that are stacked in that order from a side nearer to the fixing belt 61.

In the first exemplary embodiment, the exciting coil 82 is secured between the lower surface of the outer support 83 (a surface of the outer support 83 nearer to the inner support 81) and the projections 81*b* of the inner support 81.

The inner support 81 according to the first exemplary embodiment is configured such that the top surfaces of the projections 81*b* are at a specified distance (design value) from the fixing belt 61 supported by the end cap members 67 and rotating in a substantially circular trajectory. Thus, the exciting coil 82 is in close contact with the top surfaces of the projections 81*b*. Therefore, the exciting coil 82 is positioned at a design distance from the fixing belt 61.

In the first exemplary embodiment, as described above, the plural projections 81*b* of the inner support 81 are provided at specific intervals and each extend in the longitudinal direction of the inner support 81. Therefore, plural gaps each extending in the longitudinal direction of the inner support 81 along the plural projections 81*b* are provided between the exciting coil 82 and the base 81*a* of the inner support 81. Each of the plural gaps communicates with the outside at two ends thereof (at one side end and the other side end of the inner support 81). Thus, as described separately below, cooling air is feedable into the individual gaps from the blower unit 300.

Furthermore, in the first exemplary embodiment, the outer support 83 and the inner support 81 are attached to each other at both side ends thereof in the direction of rotation of the fixing belt 61. Thus, the outer support 83 is positioned such that the lower surface thereof is closely in contact with the exciting coil 82.

Accordingly, the exciting coil 82 is secured by being closely held between the lower surface of the outer support 83 and the top surfaces of the plural projections 81*b* provided on the inner support 81.

In the first exemplary embodiment, the magnetic core 84 and the inner support 81 are attached to each other at both side ends thereof in the direction of rotation of the fixing belt 61 (see FIG. 7). Thus, the lower surface of the magnetic core 84 (a surface of the magnetic core 84 nearer to the inner support 81) is in contact with the upper surface of the outer support 83. Furthermore, in a state where the shield 85 is attached to the inner support 81, the magnetic core 84 is pressed toward the inner support 81 by the pressing member 86 provided on the lower surface of the shield 85.

In the first exemplary embodiment, the exciting coil 82 and the magnetic core 84 are insulated from each other by being spaced apart from each other with the outer support 83 interposed therebetween. Therefore, no additional gap needs to be provided between the exciting coil 82 and the magnetic core 84 so as to insulate the exciting coil 82 and the magnetic core 84 from each other. Consequently, the size of the IH heater 80 is reduced, compared with a case to which the first exemplary embodiment is not applied.

The pressing member 86 is made of, for example, an elastic material such as silicone rubber or fluoro rubber, or may be an elastic member such as a spring.

Usually, when an alternating-current magnetic field is produced by the exciting coil 82, a magnetic force acts between the magnetic core 84 provided near the exciting coil 82 and the temperature-sensitive magnetic member 64 and so forth provided on the inner peripheral side of the fixing belt 61, whereby an oscillation (magnetostriction) occurs in the exciting coil 82. Therefore, if the exciting coil 82 is attached to the inner support 81 with an elastic member (made of a material having a low Young's modulus) such as adhesive, the exciting coil 82 tends to be detached from the elastic member such as adhesive after the fixing unit 60 is used over a long accumulated period of time, because of the oscillation of the exciting coil 82. If the exciting coil 82 is detached from the elastic member such as adhesive, the exciting coil 82 may be displaced relative to the inner support 81 or may be deformed. In such a case, the distance between the exciting coil 82 and the fixing belt 61 may change from the original design value, and the density of lines of magnetic force (magnetic flux density) running from the magnetic core 84 and passing through the fixing belt 61 may partially vary on the surface of the fixing belt 61. Consequently, the magnitude of the eddy current I occurring in the fixing belt 61 may become nonuniform, resulting in partial variation in the amount of heat generated on the surface of the fixing belt 61.

Moreover, if the exciting coil 82 is attached to the inner support 81 with an elastic member such as adhesive, the exciting coil 82 and the inner support 81 need to be fixed so as not to be displaced relative to each other until the adhesive or the like is solidified. As described above, the exciting coil 82 is, for example, a coil of Litz wire in the form of closed loop in which the lines of coiled wire are bundled, and is easy to be deformed. Therefore, it is difficult to fix the exciting coil 82 to the inner support 81 without causing any displacement relative to each other until the adhesive or the like is solidified, and the positional accuracy of the exciting coil 82 relative to the inner support 81 tends to be lowered. If the positional accuracy of the exciting coil 82 relative to the inner support 81 is lowered, the amount of heat generated on the surface of the fixing belt 61 may partially vary, as with the above case.

Hence, in the IH heater 80 according to the first exemplary embodiment, the exciting coil 82 is secured between the lower surface of the outer support 83 and the projections 81*b* of the inner support 81. Thus, the exciting coil 82 is positioned relative to the fixing belt 61 without using adhesive or the like. That is, even if no adhesive or the like is used in attaching the exciting coil 82, the occurrence of displacement and deformation of the exciting coil 82 due to detaching of the adhesive or the like is suppressed, and the initial positional relationship between the fixing belt 61 and the exciting coil 82 is maintained.

The plural projections 81*b* of the inner support 81 each extend in the longitudinal direction of the inner support 81. Therefore, the exciting coil 82 is uniformly secured in the longitudinal direction. Consequently, the closeness between the exciting coil 82 and the inner and outer supports 81 and 83 is increased in the longitudinal direction, determining the position of the exciting coil 82 relative the fixing belt 61 in the longitudinal direction.

Moreover, since no adhesive or the like is necessary, the time for solidifying adhesive or the like is not included in the process of manufacturing the IH heater 80, and the exciting coil 82 is attached in a short time and at a low cost.

Blower Unit

The blower unit 300 that feeds cooling air to the IH heater 80 will now be described. Referring to FIG. 2, the blower unit 300 includes a fan 301 that creates a flow of cooling air for cooling the exciting coil 82, a feed duct 302 through which the cooling air from the fan 301 is fed to the IH heater 80, and an exhaust duct 303 from which the cooling air that have passed through the IH heater 80 is exhausted.

Although the first exemplary embodiment concerns a case where the blower unit 300 is included in the fixing unit 60, the present invention is not limited thereto. For example, the fan 301, the feed duct 302, and the exhaust duct 303 of the blower unit 300 may be provided on the body of the image forming apparatus 1, with the fixing unit 60 provided in the image forming apparatus 1, such that the feed duct 302 and the exhaust duct 303 of the blower unit 300 are connected to the IH heater 80 of the fixing unit 60.

Fixing Operation

A fixing operation performed by the fixing unit 60 according to the first exemplary embodiment will now be described.

The paper P having the toner image superposition electrostatically transferred thereto at the second transfer part T (see FIG. 1) in the image forming apparatus 1 is transported toward the nip part N (see FIG. 3) formed by the fixing belt 61 and the pressure applying roller 62 of the fixing unit 60. At the nip part N, the toner image superposition on the paper P is heated and pressed between the fixing belt 61 heated by the IH heater 80 and the pressure applying roller 62, thereby being fused and fixed on the paper P.

The paper P exiting the nip part N formed by the fixing belt 61 and the pressure applying roller 62 tends to advance straight in a direction of exit from the nip part N with its own stiffness. Therefore, the leading end of the paper P is separated from the fixing belt 61 that rotates along the curved trajectory. Thus, the release assisting member 70 is placed between the leading end of the paper P and the fixing belt 61, whereby the paper P is released from the surface of the fixing belt 61. Subsequently, the paper P is transported to the paper stacking part 45 in the paper output portion of the image forming apparatus 1.

Now, a state where the fixing belt 61 is heated by the IH heater 80 in the fixing operation will be described.

When a toner-image-forming operation is started in the image forming apparatus 1, the controller 31 (see FIG. 1) outputs a control signal to the exciting circuit 88 of the IH heater 80 and supplies an alternating current to the exciting coil 82. When the alternating current is supplied to the exciting coil 82, an alternating-current magnetic field centered on the Litz wire coiled in the form of a closed loop is produced around the exciting coil 82. The lines of magnetic force of the alternating-current magnetic field produced by the exciting coil 82 form a magnetic path intersecting the fixing belt 61, running through the temperature-sensitive magnetic member 64, and returning to the exciting coil 82.

In each of regions of the conductive heating layer 612 of the fixing belt 61 where the lines of magnetic force run in the thickness direction, an eddy current I proportional to the amount of change in the number of lines of magnetic force per unit area (the magnetic flux density) occurs. The eddy current I occurring in the conductive heating layer 612 generates Joule heat W ($W=I^2R$), which is the product of the resistivity R of the conductive heating layer 612 and the square of the eddy current I. The fixing belt 61 is heated with this Joule heat W.

As with the conductive heating layer 612, the exciting coil 82 according to the first exemplary embodiment has a specific resistance value. Therefore, when an alternating current for heating the fixing belt 61 is supplied from the exciting circuit 88, the exciting coil 82 generates Joule heat corresponding to its resistance value and is thus self-heated. When the exciting coil 82 is self-heated and the temperature thereof rises, the resistance value of the exciting coil 82 becomes higher and the power consumption thereof increases, making it difficult to efficiently cause an eddy current I in the fixing belt 61. If the amount of heat generated is large, the exciting coil 82 may be, for example, deteriorated by the heat, resulting in a reduction in the durability thereof, or it may become difficult to assuredly insulate the lines of Litz wire forming the exciting coil 82 from one another.

To avoid such situations, the IH heater 80 according to the first exemplary embodiment has a function of suppressing an excessive rise in temperature of the exciting coil 82.

Function of Suppressing Rise in Temperature of Exciting Coil

The function of suppressing the rise in temperature of the exciting coil 82 will now be described.

In the first exemplary embodiment, when the above fixing operation is performed, a flow of cooling air is created by the fan 301 of the blower unit 300. The cooling air is fed through the feed duct 302 provided at one end of the IH heater 80 and flows from the one end into the individual gaps, communicating with the outside, provided between the exciting coil 82 and the inner support 81.

The cooling air thus fed into the gaps flows through the gaps from the one end to the other end and is exhausted to the outside of the IH heater 80 through the exhaust duct 303 provided at the other end of the IH heater 80.

As described above, the inner support 81 according to the first exemplary embodiment has the plural projections 81*b* each extending in the longitudinal direction thereof and with which the exciting coil 82 is supported (see FIG. 6). Thus, the plural gaps are provided between the exciting coil 82 and the base 81*a* of the inner support 81 in such a manner as to extend in the longitudinal direction of the inner support 81 from one end of the inner support 81 to the other end. The plural gaps are each defined by the base 81*a* of the inner support 81, two adjacent projections 81*b*, and the exciting coil 82. In each of the gaps, the exciting coil 82 and the inner support 81 are not in contact with each other, and the surface of the exciting coil 82 is exposed.

Therefore, the cooling air flows along the surface of the exciting coil 82 in each of the gaps between the exciting coil 82 and the inner support 81 while taking the heat generated in the exciting coil 82 away from the surface of the exciting coil 82, and is exhausted to the outside of the IH heater 80.

Thus, in the fixing unit 60 according to the first exemplary embodiment, the exciting coil 82 is cooled and an excessive rise in temperature thereof is suppressed.

Second Exemplary Embodiment

A second exemplary embodiment of the present invention will now be described. Elements the same as those in the first exemplary embodiment are denoted by the same reference numerals as those in the first exemplary embodiment, and detailed description thereof is omitted herein.

Figure 8:
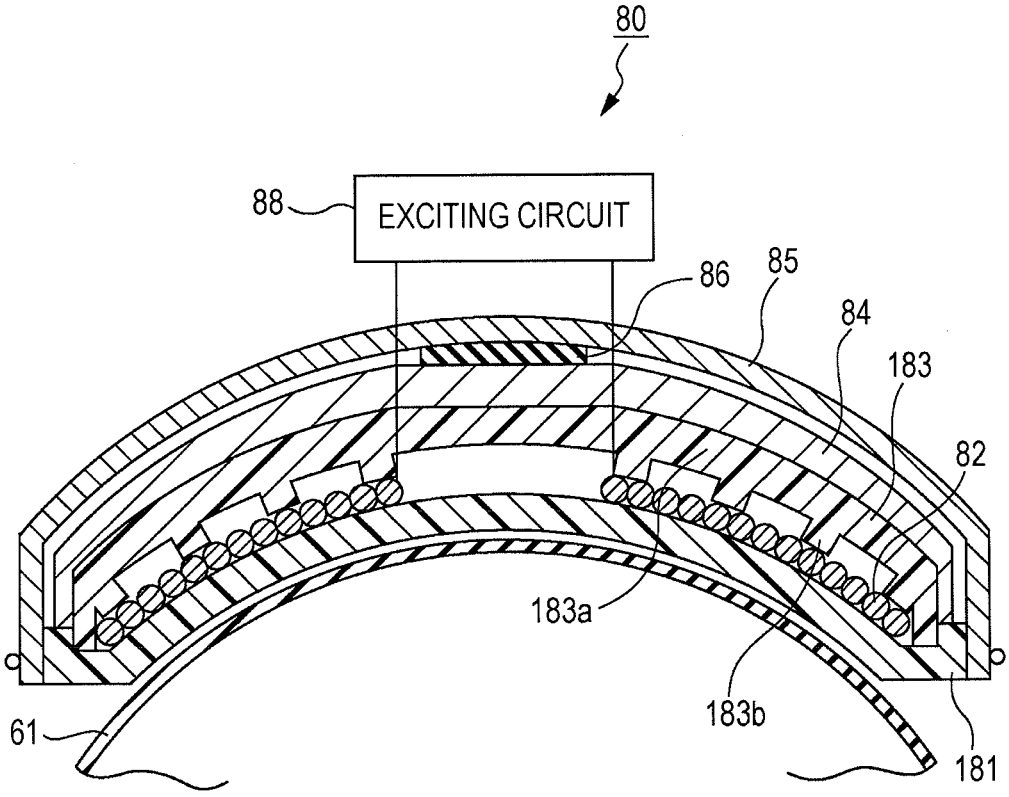
FIG. 8 is a sectional view of an IH heater according to a second exemplary embodiment.

FIG. 8 is a sectional view of an IH heater 80 according to the second exemplary embodiment. As illustrated in FIG. 8, the IH heater 80 according to the second exemplary embodiment includes the exciting coil 82, an inner support 181 and an outer support 183 supporting the exciting coil 82, the magnetic core 84, the shield 85, the pressing member 86, and the exciting circuit 88.

The inner support 181 according to the second exemplary embodiment has a curved sectional shape extending along the surface of the fixing belt 61.

The outer support 183 according to the second exemplary embodiment includes a base 183*a* having a curved sectional shape extending along the surface of the exciting coil 82, and plural projections 183*b* projecting from the base 183*a* toward the exciting coil 82. The plural projections 183*b* are exemplary protrusions and each extend in a direction orthogonal to the direction of rotation of the fixing belt 61 and from one end of the outer support 183 to the other end (in the longitudinal direction of the fixing belt 61). The projections 183*b* are provided at specific intervals.

Unlike the first exemplary embodiment in which the inner support 81 has the plural projections 81*b*, the second exemplary embodiment employs a configuration in which the outer support 183, not the inner support 181, has the plural projections 183*b*.

In the second exemplary embodiment, the exciting coil 82 is secured between the upper surface of the inner support 181 (a surface of the inner support 181 nearer to the outer support 183) and the projections 183*b* of the outer support 183. The inner support 181 according to the second exemplary embodiment is configured such that the upper surface thereof is at a specified distance (design value) from the fixing belt 61. Thus, the exciting coil 82 is in close contact with the upper surface of the inner support 181. Accordingly, the exciting coil 82 is positioned at a design distance from the fixing belt 61.

In the second exemplary embodiment, the outer support 183 and the inner support 181 are attached to each other at both side ends thereof in the direction of rotation of the fixing belt 61. Thus, the outer support 183 is positioned such that the bottom surfaces of the projections 183*b* provided thereon (surfaces of the projections 183*b* nearer to the inner support 181) are closely in contact with the exciting coil 82.

In the second exemplary embodiment, as described above, the plural projections 183*b* of the outer support 183 are provided at specific intervals and each extend in the longitudinal direction of the outer support 183. Therefore, plural gaps are provided between the exciting coil 82 and the base 183*a* of the outer support 183 in such a manner as to extend in the longitudinal direction of the outer support 183 along the plural projections 183*b*. Furthermore, in each of the gaps, the exciting coil 82 and the outer support 183 are not in contact with each other, and the surface of the exciting coil 82 is exposed.

Now, a function of suppressing the rise in temperature of the exciting coil 82 will be described.

In the second exemplary embodiment, when the above fixing operation is performed, a flow of cooling air is created by the fan 301 of the blower unit 300. The cooling air is fed through the feed duct 302 provided at one end of the IH heater 80 and flows from the one end into the individual gaps, communicating with the outside, provided between the exciting coil 82 and the outer support 183.

The cooling air thus fed into the gaps flows through the gaps from the one end to the other end and is exhausted to the outside of the IH heater 80 through the exhaust duct 303 provided at the other end of the IH heater 80.

As described above, in the second exemplary embodiment, the plural gaps are provided between the exciting coil 82 and the base 183*a* of the outer support 183 in such a manner as to extend in the longitudinal direction of the outer support 183 from one end of the outer support 183 to the other end. The plural gaps are each defined by the base 183*a* of the outer support 183, two adjacent projections 183*b*, and the exciting coil 82. In each of the gaps, the exciting coil 82 and the outer support 183 are not in contact with each other, and the surface of the exciting coil 82 is exposed.

Therefore, the cooling air flows along the surface of the exciting coil 82 in each of the gaps between the exciting coil 82 and the outer support 183 while taking the heat generated in the exciting coil 82 away from the surface of the exciting coil 82, and is exhausted to the outside of the IH heater 80.

Thus, in the fixing unit 60 according to the second exemplary embodiment also, the exciting coil 82 is cooled and an excessive rise in temperature thereof is suppressed.

Third Exemplary Embodiment

A third exemplary embodiment of the present invention will now be described. Elements the same as those in the first exemplary embodiment are denoted by the same reference numerals as those in the first exemplary embodiment, and detailed description thereof is omitted herein.

Figure 9:
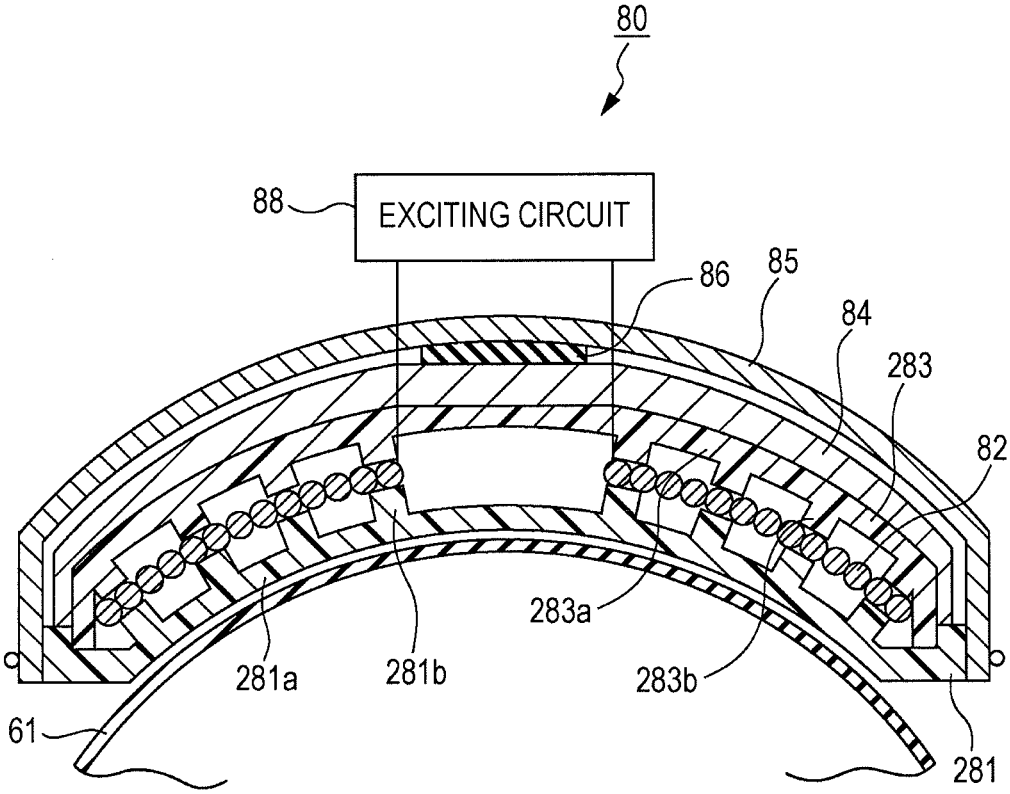
FIG. 9 is a sectional view of an IH heater according to a third exemplary embodiment.

FIG. 9 is a sectional view of an IH heater 80 according to the third exemplary embodiment. As illustrated in FIG. 9, the IH heater 80 according to the third exemplary embodiment includes the exciting coil 82, an inner support 281 and an outer support 283 supporting the exciting coil 82, the magnetic core 84, the shield 85, the pressing member 86, and the exciting circuit 88.

The inner support 281 according to the third exemplary embodiment includes a base 281*a* having a curved sectional shape extending along the surface of the exciting coil 82, and plural projections 281*b* projecting from the base 281*a* toward the exciting coil 82. The plural projections 281*b* are exemplary protrusions and each extend in a direction orthogonal to the direction of rotation of the fixing belt 61 and from one end of the inner support 281 to the other end (in the longitudinal direction of the fixing belt 61). The projections 281*b* are provided at specific intervals.

The outer support 283 according to the third exemplary embodiment includes a base 283*a* having a curved sectional shape extending along the surface of the exciting coil 82, and plural projections 283*b* projecting from the base 283*a* toward the exciting coil 82. The plural projections 283*b* are exemplary protrusions and each extend in the direction orthogonal to the direction of rotation of the fixing belt 61 and from one end of the outer support 283 to the other end (in the longitudinal direction of the fixing belt 61). The projections 283*b* are provided at specific intervals.

Unlike the first exemplary embodiment in which the inner support 81 has the plural projections 81*b*, the third exemplary embodiment employs a configuration in which the inner support 281 has the plural projections 281*b* and the outer support 283 has the plural projections 283*b*.

In the third exemplary embodiment, the exciting coil 82 is secured between the projections 281*b* of the inner support 281 and the projections 283*b* of the outer support 283. The inner support 281 according to the third exemplary embodiment is configured such that the top surfaces of the projections 281*b* are at a specified distance (design value) from the fixing belt 61. Thus, the exciting coil 82 is in close contact with the top surfaces of the projections 281*b*. Accordingly, the exciting coil 82 is positioned at a design distance from the fixing belt 61.

In the third exemplary embodiment, the outer support 283 and the inner support 281 are attached to each other at both side ends thereof in the direction of rotation of the fixing belt 61. Thus, the outer support 283 is positioned such that the bottom surfaces of the projections 283*b* thereof (surfaces of the projections 283*b* nearer to the inner support 281) are closely in contact with the exciting coil 82.

In the third exemplary embodiment, as described above, the plural projections 281*b* of the inner support 281 are provided at specific intervals and each extend in the longitudinal direction of the inner support 281. Therefore, plural gaps are provided between the exciting coil 82 and the base 281*a* of the inner support 281 in such a manner as to extend in the longitudinal direction of the inner support 281 along the plural projections 281*b*. In each of the gaps, the exciting coil 82 and the inner support 281 are not in contact with each other, and the surface of the exciting coil 82 is exposed.

Furthermore, in the third exemplary embodiment, the plural projections 283*b* of the outer support 283 are provided at specific intervals and each extend in the longitudinal direction of the outer support 283. Therefore, plural gaps are provided between the exciting coil 82 and the base 283*a* of the outer support 283 in such a manner as to extend in the longitudinal direction of the outer support 283 along the plural projections 283*b*. In each of the gaps, the exciting coil 82 and the outer support 283 are not in contact with each other, and the surface of the exciting coil 82 is exposed.

Now, a function of suppressing the rise in temperature of the exciting coil 82 will be described.

In the third exemplary embodiment, when the above fixing operation is performed, a flow of cooling air is created by the fan 301 of the blower unit 300. The cooling air is fed through the feed duct 302 provided at one end of the IH heater 80 and flows from the one end into the individual gaps, communicating with the outside, provided between the exciting coil 82 and the inner support 281 and between the exciting coil 82 and the outer support 283.

The cooling air thus fed into the gaps flows through the gaps from the one end to the other end and is exhausted to the outside of the IH heater 80 through the exhaust duct 303 provided at the other end of the IH heater 80.

As described above, in the third exemplary embodiment, the plural gaps are provided between the exciting coil 82 and the base 281*a* of the inner support 281 in such a manner as to extend in the longitudinal direction of the inner support 281 from one end of the inner support 281 to the other end. The plural gaps are each defined by the base 281*a* of the inner support 281, two adjacent projections 281*b*, and the exciting coil 82. In each of the gaps, the exciting coil 82 and the inner support 281 are not in contact with each other, and the surface of the exciting coil 82 is exposed. Furthermore, in the third exemplary embodiment, the plural gaps are also provided between the exciting coil 82 and the base 283*a* of the outer support 283 in such a manner as to extend in the longitudinal direction of the outer support 283 from one end of the outer support 283 to the other end. The plural gaps are each defined by the base 283*a* of the outer support 283, two adjacent projections 283*b*, and the exciting coil 82. In each of the gaps, the exciting coil 82 and the outer support 283 are not in contact with each other, and the surface of the exciting coil 82 is exposed.

Therefore, the cooling air flows along the surface of the exciting coil 82 in each of the gaps defined between the exciting coil 82 and the inner support 281 and between the exciting coil 82 and the outer support 283 while taking the heat generated in the exciting coil 82 away from the surface of the exciting coil 82, and is exhausted to the outside of the IH heater 80.

Thus, in the fixing unit 60 according to the third exemplary embodiment also, the exciting coil 82 is cooled and an excessive rise in temperature thereof is suppressed.

In each of the first to third exemplary embodiments, the plural projections (the projections 81*b*, 183*b*, or 281*b* and 283*b*) extend in the longitudinal direction of the fixing belt 61 (in the longitudinal direction of the exciting coil 82). In the exciting coil 82, many lines of the coiled Litz wire extend in the longitudinal direction of the exciting coil 82. Therefore, with the plural projections extending in the longitudinal direction of the exciting coil 82, the plural gaps through which the cooling air flows are more easily made to extend along the lines of Litz wire than in a case to which none of the exemplary embodiments are applied. Accordingly, the surface of the exciting coil 82 becomes less irregular in each of the gaps, allowing the cooling air to flow smoothly. Thus, the heat taken away from the exciting coil 82 by the cooling air is smoothly exhausted to the outside of the IH heater 80. Consequently, the rise in temperature of the exciting coil 82 is suppressed more than in the case to which none of the exemplary embodiments are applied.

Furthermore, with the plural projections extending in the longitudinal direction of the exciting coil 82, the projections are easily made to extend along the lines of Litz wire forming the exciting coil 82. Hence, the probability that the projections may intersect the lines of Litz wire becomes lower than that in the case to which none of the exemplary embodiments are applied. Therefore, in a state where the exciting coil 82 is held between the inner support 81 (the inner support 181 or 281) and the outer support 83 (the outer support 183 or 283), the projections prevent the exciting coil 82 from being distorted. Consequently, the exciting coil 82 is supported more stably than in the case to which none of the exemplary embodiments are applied.

If it is possible to provide any gaps that allow the cooling air to flow therethrough along the surface of the exciting coil 82, the shape and arrangement of the projections are not limited to those described above. For example, the plural projections may each extend in the direction of rotation of the fixing belt 61 or may be provided in the form of dots.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that includes a conductive layer and fixes toner on a recording material with heat generated in the conductive layer by electromagnetic induction;

a magnetic-field-producing member that produces an alternating-current magnetic field when an alternating current is supplied to the magnetic-field-producing member, the alternating-current magnetic field intersecting the conductive layer;

a first support member that faces the magnetic-field-producing member and has a first projection which projects toward the magnetic-field-producing member, the first support member supporting the magnetic-field-producing member at the first projection; and a second support member that faces the first support member with the magnetic-field-producing member interposed therebetween, the second support member supporting the magnetic-field-producing member by pressing the magnetic-field-producing member against the first support member, wherein the first projection projects toward the magnetic-field-producing member such that an upward surface of the first projection, which is opposite to an inward surface of the second support member, contacts and supports the magnetic-field-producing member.

2. The fixing device according to claim 1, wherein the fixing member is rotatably supported, and wherein the first projection extends in a longitudinal direction of the fixing member.

3. The fixing device according to claim 1, further comprising a magnetic core member that produces a magnetic path which induces the alternating-current magnetic field produced by the magnetic-field-producing member into the fixing member, wherein the first support member is provided between the fixing member and the magnetic-field-producing member, and wherein the second support member is provided between the magnetic-field-producing member and the magnetic core member and supports the magnetic-field-producing member and the magnetic core member such that the magnetic-field-producing member does not contact the magnetic core member.

4. The fixing device according to claim 1, further comprising a blower member that feeds a flow of air in between the second support member and the magnetic-field-producing member.

5. A fixing device comprising:

a fixing member that includes a conductive layer and fixes toner on a recording material with heat generated in the conductive layer by electromagnetic induction;

a magnetic-field-producing member that produces an alternating-current magnetic field when an alternating current is supplied to the magnetic-field-producing member, the alternating-current magnetic field intersecting the conductive layer;

a first support member that faces the magnetic-field-producing member and has a first projection which projects toward the magnetic-field-producing member, the first support member supporting the magnetic-field-producing member at the first projection; and a second support member that faces the first support member with the magnetic-field-producing member interposed therebetween, the second support member supporting the magnetic-field-producing member by pressing the magnetic-field-producing member against the first support member, wherein the second support member has a second projection projecting toward the magnetic-field-producing member, and wherein the first projection and the second projection support the magnetic-field-producing member by being in contact with the magnetic-field-producing member.

6. A fixing device comprising:

a fixing member that includes a conductive layer and fixes toner on a recording material with heat generated in the conductive layer by electromagnetic induction;

a magnetic-field-producing member that produces an alternating-current magnetic field when an alternating current is supplied to the magnetic-field-producing member, the alternating-current magnetic field intersecting the conductive layer;

a first support member that faces the magnetic-field-producing member and has a first projection which projects toward the magnetic-field-producing member, the first support member supporting the magnetic-field-producing member at the first projection;

a second support member that faces the first support member with the magnetic-field-producing member interposed therebetween, the second support member supporting the magnetic-field-producing member by pressing the magnetic-field-producing member against the first support member; and a blower member that feeds a flow of air in between the first support member and the magnetic-field-producing member.

7. An image forming apparatus comprising:

a toner-image-forming section that forms a toner image;

a transfer section that transfers the toner image to a recording material; and a fixing section that fixes the toner image transferred to the recording material on the recording material, wherein the fixing section includes a fixing member that includes a conductive layer and fixes toner on the recording material with heat generated in the conductive layer by electromagnetic induction;

a magnetic-field-producing member that produces an alternating-current magnetic field when an alternating current is supplied to the magnetic-field-producing member, the alternating-current magnetic field intersecting the conductive layer;

a first support member that is provided between the fixing member and the magnetic-field-producing member;

a second support member that faces the first support member with the magnetic-field-producing member interposed therebetween; and a protrusion that is provided on at least one of the first support member and the second support member and supports the magnetic-field-producing member such that a gap is provided between the magnetic-field-producing member and the at least one of the first support member and the second support member, wherein the protrusion projects toward the magnetic-field-producing member such that an upward surface of the protrusion, which is opposite to an inward surface of the first support member or the second support member, contacts and supports the magnetic-field-producing member.

8. The image forming apparatus according to claim 7, wherein the fixing member is rotatably supported, and wherein the protrusion is one of a plurality of protrusions each extending in a longitudinal direction of the fixing member, the plurality of protrusions defining the gap in such a manner as to extend in the longitudinal direction.

9. The image forming apparatus according to claim 7, further comprising a blower included in the fixing section, the blower feeding a flow of air into the gap provided between the magnetic-field-producing member and the at least one of the first support member and the second support member.

10. The image forming apparatus according to claim 7, further comprising a blower provided separately from the fixing section, the blower feeding a flow of air into the gap provided between the magnetic-field-producing member and the at least one of the first support member and the second support member.

11. The image forming apparatus according to claim 7, wherein the fixing section further includes a magnetic core member facing the magnetic-field-producing member with the second support member interposed therebetween in such a manner as not to contact the magnetic-field-producing member, the magnetic core member producing a magnetic path that induces the alternating-current magnetic field produced by the magnetic-field-producing member into the fixing member.

12. An image forming apparatus comprising:

a toner-image-forming section that forms a toner image;

a transfer section that transfers the toner image to a recording material; and a fixing section that fixes the toner image transferred to the recording material on the recording material, wherein the fixing section includes a fixing member that includes a conductive layer and fixes toner on the recording material with heat generated in the conductive layer by electromagnetic induction;

a magnetic-field-producing member that produces an alternating-current magnetic field when an alternating current is supplied to the magnetic-field-producing member, the alternating-current magnetic field intersecting the conductive layer;

a first support member that is provided between the fixing member and the magnetic-field-producing member;

a second support member that faces the first support member with the magnetic-field-producing member interposed therebetween;

a first protrusion that is provided on the first support member and supports the magnetic-field-producing member such that a gap is provided between the magnetic-field-producing member and the first support member; and a second protrusion that is provided on the second support member and supports the magnetic-field-producing member such that a gap is provided between the magnetic-field-producing member and the second support member.

* * * * *